US006228427B1

(12) United States Patent
Wanger

(10) Patent No.: US 6,228,427 B1
(45) Date of Patent: May 8, 2001

(54) PRODUCTION PROCESS FOR 3-D IMAGES

(75) Inventor: Markus Wanger, Vaduz (LI)

(73) Assignee: Wanger Holding Anstalt, Vaduz (LI)

( * ) Notice: Subject to any disclaimer, the term of this patent is extended or adjusted under 35 U.S.C. 154(b) by 0 days.

(21) Appl. No.: 09/285,943

(22) Filed: Apr. 1, 1999

(30) Foreign Application Priority Data

Apr. 2, 1998 (CH) ..... 0798/98

(51) Int. Cl.[7] ..... B05D 5/06

(52) U.S. Cl. ..... 427/258; 427/261; 427/264; 427/265; 427/277; 427/355; 427/358

(58) Field of Search ..... 434/82, 84; 428/15–17; 427/258, 261, 264, 262, 267, 270, 277, 355, 358, 265

(56) References Cited

U.S. PATENT DOCUMENTS 1,410,344 * 3/1922 Ornstein .
1,608,281 * 11/1926 Weber .
2,085,875 * 7/1937 Sirovy .
3,744,152 * 7/1973 Crasilneck .
3,808,024 * 4/1974 Witman .
3,877,958 * 4/1975 Ishii .
4,578,131 * 3/1986 Hawkins, Jr. .
4,659,319 * 4/1987 Blair .

FOREIGN PATENT DOCUMENTS 651 785 * 10/1985 (CH) .
2518968A1 11/1976 (DE) .
4325085A1 1/1995 (DE) .
2 218 946 11/1989 (GB) .

* cited by examiner

*Primary Examiner*—Fred J. Parker
(74) *Attorney, Agent, or Firm*—Seed IP Law Group PLLC

(57) ABSTRACT

Production process for 3-D structural images, wherein a structural mass is first applied to an untreated or treated picture carrier, giving rise to a character in relief, after which color and other colors, solvents, pigments, water or diluting agents, if required, are applied by shaking, rinsing and skimming techniques, resulting in an art work (3-D structural image) having a realistic effect from the graphic to the abstract, which exhibits at the same time both an expressionistic and an impressionistic effect.

12 Claims, 3 Drawing Sheets

PRODUCTION PROCESS FOR 3-D IMAGES

The present invention relates to a production process for structured coloured motifs, and may be designated as 3-D image painting.

The object of the invention is to develop a process, wherein various directions in style, such as Impressionism and Expressionism, can be interconnected by means of a special technique, and which can then be designated In effect as 3-D structuralism (3-D Image). The novelty of this technique accordingly lies in the result (3-D structuralism) of the combining of different techniques into a new unit of way of representing form of expression.

Accordingly, the present invention relates to a production process for 3-D structural images, characterised in that a structural mass is applied to an untreated or treated picture carrier to which colour is applied in a liquid form, for example (dissolved in turpentine) or in a pulverulent or granular form by means of a shaking, rinsing or skimming technique, whereby the coating of colour is shaped by use of mechanical/technical aids and the corresponding colour coating is applied by use of different colours in order to form a planned motif through the given structure by way of this technique, which is treated by application of colour in such a way that the desired 3-D structural effect results.

In detail, a picture carrier a) according to the present invention is prepared preferably with a primer in accordance with a known method.

Examples of suitable picture carriers are fabrics such as canvas, linen or cotton, as well as materials such as wood, paper, cardboard, stone, clay (raw or fired), metal, porcelain and the like.

The result thereof is a primed picture carrier b) which prevents the absorption of colour on picture carrier a). Another possibility is to use a primed picture carrier b) from the beginning.

The untreated picture carrier b) or pre-treated as above, preferably primed in white, can then be provided with a completely or partially graphical picture, or with an abstract motif. This is achieved by means of, for instance, chalk, charcoal, pencil and the like. This

CROSS-REFERENCE TO RELATED APPLICATION

This application claims priority from Switzerland Application No. 1998 0798/98, filed Apr. 2, 1998.

TECHNICAL FIELD

The present invention relates to a production process for structured colored motifs, and may be designated as 3-D image painting.

BACKGROUND OF THE INVENTION

The object of the invention is to develop a process, wherein various directions in style, such as Impressionism and Expressionism, can be interconnected by means of a special technique, and which can then be designated in effect as 3-D structuralism (3-D image). The novelty of this technique accordingly lies in the result (3-D structuralism) of the combining of different techniques into a new unit of way of representing form of expression.

SUMMARY OF THE INVENTION

Accordingly, the present invention relates to a production process for 3-D structural images, characterized in that a structural mass is applied to an untreated or treated picture carrier to which color is applied in a liquid form, for example (dissolved in turpentine) or in a pulverulent or granular form by means of a shaking, rinsing or skimming technique, whereby the coating of color is shaped by use of mechanical/technical aids and the corresponding color coating is applied by use of different colors in order to form a planned motif through the given structure by way of this technique, which is treated by application of color in such a way that the desired 3-D structural effect results.

DETAILED DESCRIPTION OF THE ILLUSTRATED EMBODIMENT

Figure 1:
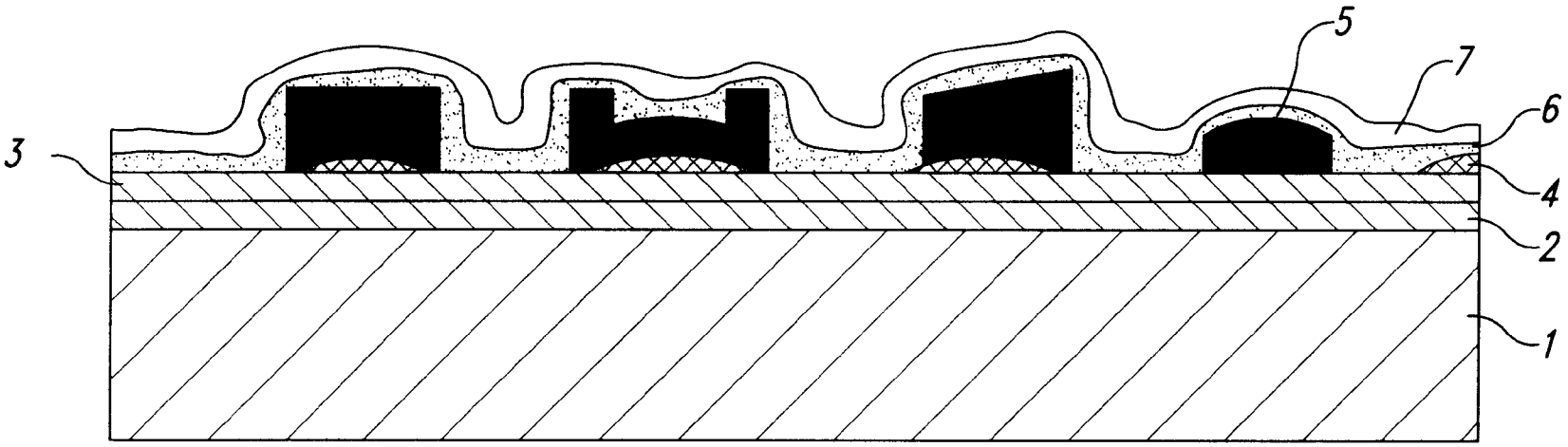
FIG. 1 is a cross-sectional view of a 3-dimensional image according to one embodiment of the present invention.

In detail, best illustrated in FIG. 1, a picture carrier 1 according to an embodiment of the present invention is prepared preferably with a primer 2 in accordance with a known method.

Examples of suitable picture carriers 1 are fabrics such as canvas, linen or cotton, as well as materials such as wood, paper, cardboard, stone, clay (raw or fired), metal, porcelain and the like.

The result thereof is a primed picture carrier 1 and 2 which prevents the absorption of color on picture carrier 1. Another possibility is to use a primed picture carrier 1 and 2 from the beginning.

The untreated picture carrier 1 or pre-treated as above, preferably primed in white, can then be provided with a completely or partially graphical sketch or picture 4, or with an abstract motif This is achieved by means of, for instance, chalk, charcoal, pencil and the like. This picture 4 can be, for example, an architectonic representation, but also may be any other completely or partially graphical or abstract representation. The result is a graphical sketch on an untreated or primed picture carrier I (Priming coat).

A structural mass 5 is applied to completely or partially cover this graphical sketch 4, in such a way that the fundamental structures of the picture are applied or trowelled on by use of graphical sketch.

The structural mass 5 can be a trowelled mass, for example, such as a structural paste, acrylic resin, plaster or clay, or in the case of metal as picture carrier it can be soldering lead or similar. The coating is applied either by hand or by means of a tool such as scraper, trowel, knife, brush and the like, or directly by tube.

The result thereof is a three-dimensional structure with troughs and above all with corresponding raised edges. During the procedure new motifs can be used, over and above the sketch, in free choice. The motifs applied to the untreated or treated picture carriers 1 and the structures of the structural mass 5 can also permit retouching, painting over and retrowelling, and can be completed by this process.

A semi-graphical painting is thus achieved which not only displays a plastic 3-D structural effect in relief, but also results in the picture becoming alienated and having an abstract effect.

It is of fundamental importance to always illustrate edge lines of the motif by means of the structural mass 5, so that shapes, raised sections and troughs result.

The spatial, three-dimensional effect is created by the selected structures.

The edges delimiting the individual parts of the motif form heights and depths and are as such important to further treatment of the image.

An impressive effect of the image is given by the abstracting of the graphical illustration.

Consequently, in a further step, color 6 is applied to the image by way of pigments, if required. The importance here is that this color 6 or pigment adheres well both to the untreated or primed/treated picture carrier 1 and to the structural mass 5, and also that the various colors 6 and pigments which are applied intermingle at least partially.

The used colors 6 are mostly shaken, rinsed and/or skimmed with corresponding diluting agents or solvents so that they can be thoroughly mixed in. As generally understood in the art, rinsing means to shake drops of solution off of a medium, such as glass, and skimming means removing solution using a tool, such as a spoon.

The color(s) 6 or pigments are applied by shaking, rinsing and/or kimming techniques.

The applied color 6 may be, for example, an oil color, a synthetic resin lacquer, an acrylic color or an emulsion paint.

The result of the selection of different colors 6, which flow and merge into one another, is expressive images which already have an effect.

Additional structures and alienation effects can be achieved by application of more coloring agents, or solvents, pigments, water or diluting agents.

The color 6 or color mixture collects in the deepest parts of the applied structure into a thicker, concentrated and accordingly darker and brighter color coating, and forms a thinner color coating on the embossed structural points away from which the color is flowing.

The result of this is 3-D structural images in connection with the structure applied to the picture carrier 1.

The uppermost paint layer 6 is applied preferably in the manner of abstract Expressionism. Other styles are also feasible. Lying beneath this uppermost paint layer is the structure which is perceived as an independent motif This was previously applied to the priming coat or preferably directly to the undercoat.

Additional effects can be achieved through the selective use of other techniques or the repetition of the same technique, the application of paint sprays, the use of different solvents, direct sprinkling or mixing of pigments.

As a finishing treatment a transparent or slightly tinted layer of varnish 7 can be applied, which can serve as UV protection on the one hand, but which also can result in a more matt or shinier image.

The result is an expressive piece of art having an impressionistic, realistic effect, as well as a partially abstract three-dimensional effect, which can be described as a 3-D structural image.

It was not foreseen with this novel technique of the application of the structural mass 5 in conjunction with the color 6 coating applied thereon that an effect would be achieved which allows the illustrated image to appear three-dimensional with deep action which on the one hand offer the observer magnificent color compositions, and on the other hand offer structures varying from the graphical to the abstract. The composition of the color 6 may evoke varying moods in the observer. Whereas yellow, blue and red, for instance, indicate clear states, mixed colors leave space on both sides. Color and form possess inherent dynamics. Through the color the structure can be experienced, or the color can be observed in isolation as an image composition. Only through the blending of color and structure through the observer does the overall work become a three-dimensional experience.

In FIG. 1, which illustrates one embodiment of the present invention, the reference numbers have the following definitions:

1) designates an untreated picture carrier, which

2) is treated with an undercoating material,

3) is the layer of undercoat, and

4) illustrates the motif (sketch).

5) The structural mass lies directly on the motif (4),

6) illustrates the color layer, and

7) also illustrates the transparent or slightly tinted finishing layer of varnish.

Layers 1 to 4 correspond to the treated picture carrier and layers 5 to 7 produce the 3-D structural image.

Figure 2:
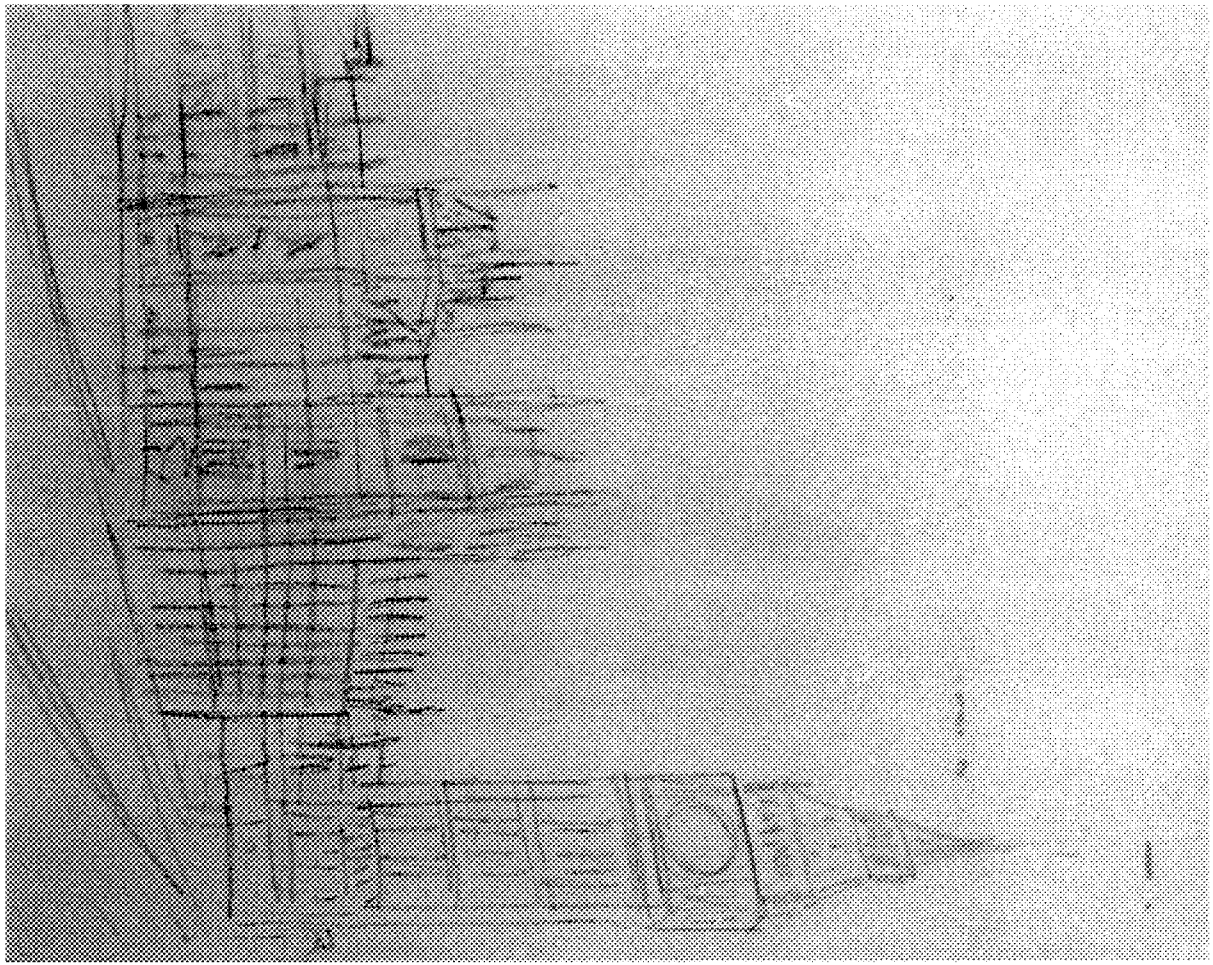
FIG. 2 is a photograph illustrating a partially completed 3-dimensional image at one step in the process of the present invention.

FIG. 2 illustrates a picture on which an untreated picture carrier was treated with an undercoating material followed with a priming coat and sketch (step 1 to 4 of the schematic presentation).

Figure 3:
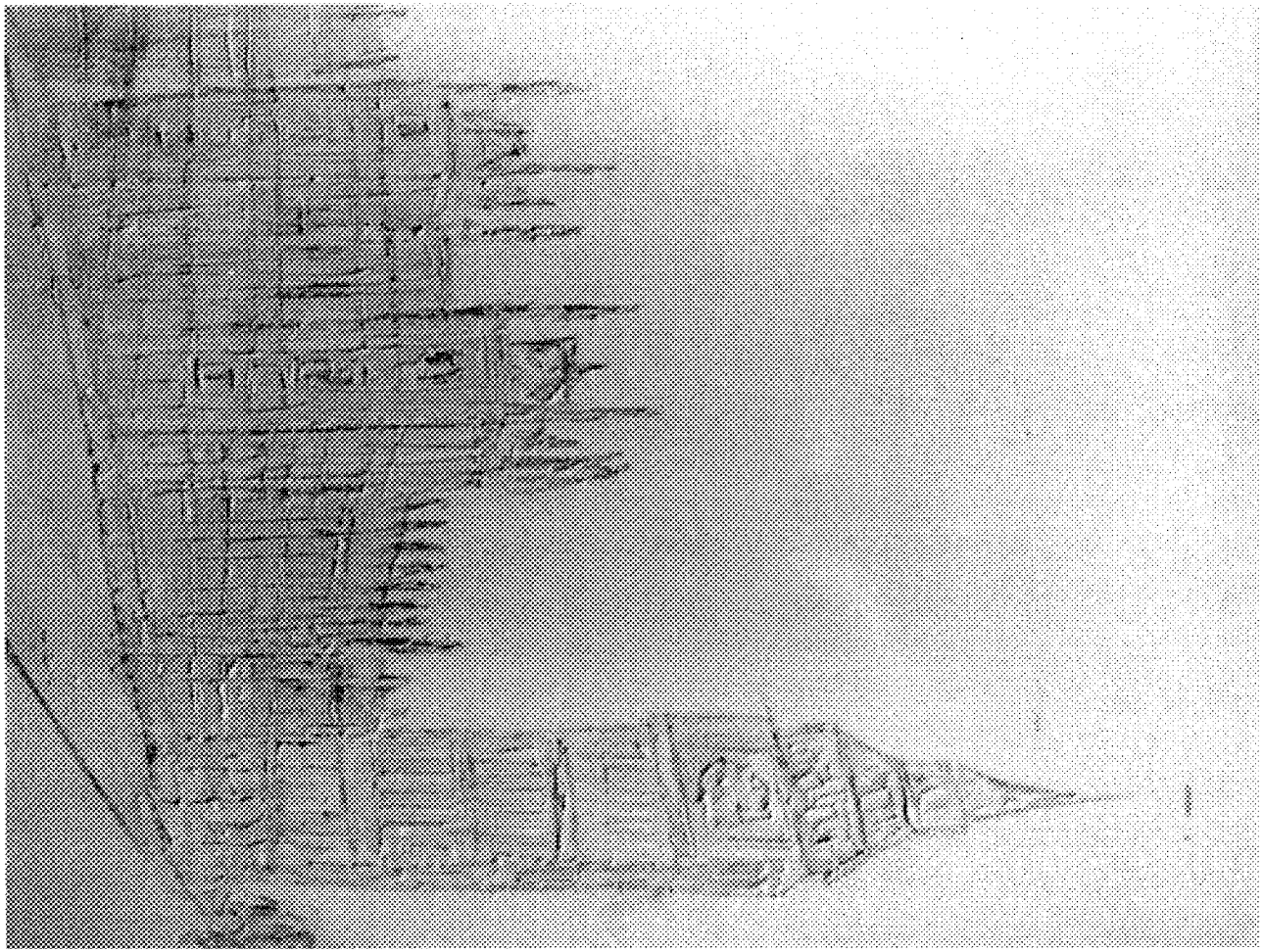
FIG. 3 is a photograph illustrating a partially completed 3-dimensional image at another step in the process of the present invention.

FIG. 3 illustrates a picture on which additionally to the picture of the presentation A the structural mass was applied (step 1 to 5 of the schematic presentation).

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A process for making three-dimensional images, the process comprising:

applying a structural mass to at least a portion of a picture carrier to create a three-dimensional motif;

applying a coating having at least a first color and a second color to the structural mass and the picture carrier to create a colored pattern, the colored pattern being different from the three-dimensional motif; and shaping the coating by manual manipulation to create thin portions of the coating and thick portions of the coating corresponding to the motif, the thin portions of the coating differing in appearance from the thick portions of the coating to highlight the motif such that the motif and the colored pattern are both visible to a viewer.

2. A three-dimensional structural image made using the process as claimed in claim 1, whereby the three-dimensional structural image creates a three-dimensional effect.

3. The process as claimed in claim 1, further comprising first preparing one of a sketch or a diagram on the picture carrier and wherein applying the structural mass comprises applying the structural mass to at least a portion of the one of a sketch and a diagram, whereby the motif has a three-dimensional structure corresponding to the one of a sketch and a diagram.

4. The process as claimed in claim 1, wherein applying the coating comprises applying at least two different colors and/or pigments to the structural mass and picture carrier, and wherein the two different colors and/or pigments are at least partially mixed together on the carrier itself.

5. The process as claimed in claim 1, wherein applying a structural mass comprises creating a surface having a plurality of raised edges and troughs, and wherein applying the coating comprises applying a mixture of the first color and the second color to the structural mass and the picture carrier, the portion of the mixture applied to the troughs having a first thickness and the portion of the mixture applied to the raised edges having a second thickness less than the first thickness, the coating having the first thickness being concentrated and accordingly darker than the coating having the second thickness.

6. The process as claimed in claim 1, further comprising applying a varnish to the structural image and the colored coating to serve as UV protection.

7. The process as claimed in claim 1, further comprising applying one of a single-color and a multi-color undercoat to the picture carrier, then applying one of a sketch and a diagram to the undercoat, prior to applying the structural mass.

8. An image produced according to the process claimed in claim 1 wherein the structural mass creates an impressionistic image and the colored coating creates an expressionistic image.

9. A process for producing an image, comprising:

providing a picture carrier;

applying indicia to the picture carrier;

applying a structural mass to the picture carrier to create a motif having a three-dimensional structure corresponding to the indicia;

applying a colored coating to the picture carrier, the colored coating having a pattern distinct from the motif, and manipulating the colored coating to create areas of varying thickness corresponding to the motif such that the motif and pattern are separately visible to the viewer.

10. The process of claim 9, further comprising treating the picture carrier prior to applying the indicia thereto.

11. The process of claim 9 wherein applying the colored coating comprises one of shaking, rinsing and skimming the colored coating.

12. The process of claim 9 wherein manipulating the colored coating comprises shaping the colored coating with a tool.

* * * * *

UNITED STATES PATENT AND TRADEMARK OFFICE

CERTIFICATE OF CORRECTION

PATENT NO. : 6,228,427 B1
APPLICATION NO. : 09/285943
DATED : May 8, 2001
INVENTOR(S) : Dr. Markus Wanger It is certified that error appears in the above-identified patent and that said Letters Patent is hereby corrected as shown below:

On the title page item (75), Inventor, "Markus Wanger" should read --Dr. Markus Wanger--.

Claim 7, column 5, line 16, "single-color and a multi-color" should read --single-color or a multi-color--.

Signed and Sealed this

Ninth Day of January, 2007

JON W. DUDAS
*Director of the United States Patent and Trademark Office*